US010539144B2

(12) United States Patent
Shen et al.

(10) Patent No.: US 10,539,144 B2
(45) Date of Patent: Jan. 21, 2020

(54) FAN CENTRAL BARREL COUPLING STRUCTURE

(71) Applicant: ASIA VITAL COMPONENTS CO., LTD., New Taipei (TW)

(72) Inventors: Meng Shen, New Taipei (TW); Xiang-You Zeng, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 319 days.

(21) Appl. No.: 15/585,113

(22) Filed: May 2, 2017

(65) Prior Publication Data

US 2018/0320701 A1 Nov. 8, 2018

(51) Int. Cl.

| | |
|---|---|
| ***F04D 29/044*** | (2006.01) |
| ***F04D 25/06*** | (2006.01) |
| ***F04D 25/08*** | (2006.01) |

(52) U.S. Cl.

CPC ..... *F04D 29/044* (2013.01); *F04D 25/064* (2013.01); *F04D 25/0646* (2013.01); *F04D 25/088* (2013.01)

(58) Field of Classification Search

CPC .. F04D 29/044; F04D 29/646; F04D 25/0646; F04D 25/064; F04D 25/088

USPC ..... 415/214.1; 310/90, 91, 156.14

See application file for complete search history.

(56) References Cited

U.S. PATENT DOCUMENTS

| | | | | |
|---|---|---|---|---|
| 3,914,071 | A * | 10/1975 | Friese | F04D 29/059 417/353 |
| 5,562,347 | A * | 10/1996 | Hsieh | F16C 35/02 384/215 |
| 5,650,678 | A * | 7/1997 | Yokozawa | H02K 5/1735 310/90 |
| 6,002,188 | A * | 12/1999 | Yagi | H02K 5/1735 310/268 |
| 6,271,611 | B1 * | 8/2001 | Taniguchi | F04D 29/057 310/89 |
| 6,447,272 | B2 * | 9/2002 | Tsuchiya | H02K 1/28 310/40 R |
| 6,501,617 | B1 * | 12/2002 | Harada | F16D 1/072 360/99.08 |
| 6,617,730 | B2 * | 9/2003 | Horng | F16C 17/08 310/90 |

(Continued)

*Primary Examiner* — Sizo B Vilakazi
*Assistant Examiner* — Brian R Kirby
(74) *Attorney, Agent, or Firm* — Jackson IPG PLLC; Demian K. Jackson

(57) ABSTRACT

A fan central tube coupling structure includes a base and a central tube. The base has a first section and a second section that together define an upward tapered receiving recess below the base. The central tube is externally provided on around a bottom end with a first and a second protruded section and an engagement groove defined between the first and second protruded sections. The second protruded section has an interference pressing surface defined on an outermost peripheral surface thereof. The central tube is axially extended through the base, such that the second protruded section is axially press-fitted into the tapered receiving recess and the interference pressing surface is radially outward forced against the tapered receiving recess. In the meantime, the second section of the base is fitted in the engagement groove and clamped in place by between the first protruded section and the second protruded section.

6 Claims, 6 Drawing Sheets

(56) References Cited

U.S. PATENT DOCUMENTS 6,819,021 B1 * 11/2004 Horng ..... H02K 5/00 310/90
6,847,141 B2 * 1/2005 Wang ..... F04D 29/057 310/67 R
6,897,586 B2 * 5/2005 Horng ..... H02K 5/15 310/67 R
7,015,610 B2 * 3/2006 Horng ..... H02K 1/187 310/90
7,399,121 B2 * 7/2008 Satoji ..... F16C 17/026 384/107
7,843,619 B1 * 11/2010 Song ..... G02B 26/121 310/90
8,212,459 B2 * 7/2012 Smirnov ..... H02K 5/1675 310/425
8,432,077 B2 * 4/2013 Won ..... F16C 17/10 310/67 R
8,915,721 B2 * 12/2014 Winkler ..... F04D 29/057 417/354
8,974,196 B2 * 3/2015 Chen ..... F04D 29/056 417/354
9,303,657 B2 * 4/2016 Chou ..... F04D 25/062
9,490,676 B2 * 11/2016 Weisser ..... F04D 29/083
9,631,638 B2 * 4/2017 Lin ..... F04D 25/062
2004/0201298 A1 * 10/2004 Horng ..... H02K 5/15 310/91
2004/0264817 A1 * 12/2004 Satoji ..... F16C 17/026 384/100
2006/0181164 A1 * 8/2006 Ho ..... H02K 29/03 310/67 R
2008/0181547 A1 * 7/2008 Chen ..... F16C 35/02 384/428
2008/0218018 A1 * 9/2008 Zhang ..... F04D 29/646 310/90
2010/0322800 A1 * 12/2010 Yeh ..... F04D 29/646 417/423.7
2013/0278085 A1 * 10/2013 Lee ..... G11B 19/2036 310/43
2014/0377093 A1 * 12/2014 Horng ..... F04D 29/662 417/410.1
2015/0188387 A1 * 7/2015 Horng ..... H02K 5/10 310/90
2017/0051758 A1 * 2/2017 Sun ..... F04D 25/062

* cited by examiner

FAN CENTRAL BARREL COUPLING STRUCTURE

FIELD OF THE INVENTION

The present invention relates to the field of fan, and more particularly, to a fan central tube coupling structure and the arrangement of the fan central tube coupling structure in a fan frame.

BACKGROUND OF THE INVENTION

A heat-dissipation fan is mainly used to produce forced air flow at a place requiring heat dissipation, so as to remove heat from the place. The heat-dissipation fan includes a rotor and a stator. When a magnetic field-induced excitation occurs between the rotor and the stator, the rotor is caused to rotate and the fan operates to produce air flow.

The rotor of the heat-dissipation fan mainly includes a shaft and a fan wheel hub having a plurality of blades formed thereon, which are assembled to each other. The stator is arranged on around an outer side of a bearing cup, i.e. a central tube, on a frame of the heat-dissipation fan to correspond to the fan wheel hub. Generally, the bearing cup of the fan is integrally formed with the fan frame through injection molding. There are also heat-dissipation fans that use a copper bearing cup, which is riveted to a base of the fan frame. However, the riveting process tends to damage the fan structure. In case of an incomplete riveting, the bearing cup tends to easily become loosen from the base of the fan frame. In addition, it is difficult to control the concentricity between the copper bearing cup and the base of the fan frame because the copper bearing cup is press-fitted into the base of the fan frame during the riveting process. Another disadvantage of using the riveted copper bearing cup is the loosen copper bearing cup will produce noise during fan operation.

It is therefore tried by the inventor to develop an improved fan central tube coupling structure to overcome the disadvantages of the conventional ways of connecting the bearing cup to the fan frame.

SUMMARY OF THE INVENTION

A primary object of the present invention is to provide a fan central tube coupling structure that enables upgraded accuracy in the coupling of a fan central tube to a base that is connected to a fan frame.

Another object of the present invention is to provide a fan central tube coupling structure that enables an increased heat transfer area between a fan central tube and a base thereof.

To achieve the above and other objects, the fan central tube coupling structure according to a first preferred embodiment of the present invention includes a base and a central tube axially coupled to the base. The base has a bottom portion with a first section and second section formed thereon, and the first section and the second section together define an upward tapered receiving recess below the second section. The central tube has a first protruded section and a second protruded section located lower than the first protruded section, such that an engagement groove is defined between the first and the second protruded section. The second protruded section is axially press-fitted into the tapered receiving recess and has an interference pressing surface defined on an outermost peripheral surface thereof adapted to radially press against the tapered receiving recess. The second section of the base is fitted in the engagement groove and clamped in place by between the first protruded section and the second protruded section.

To achieve the above and other objects, the fan central tube coupling structure according to a second preferred embodiment of the present invention includes a base and a central tube. The base has a bottom portion with a first section and a second section formed thereon; the first section stands relative to the bottom portion to upward extend and taper in an axial direction of the base; the second section is connected at a radially outer edge to the first section and has a radially inner free end that radially inward and horizontally extends to define a through hole on the base; the first section and the second section together define an upward tapered receiving recess below the second section, and the tapered receiving recess is communicable with the through hole. One side of the first section facing the tapered receiving recess is an inward inclined wall and one side of the second section facing the tapered receiving recess is a downward-facing contact surface, on which an annular pressing groove is formed. The central tube has a top end and a bottom end and internally defines a receiving space. The top end defines an opening communicable with the receiving space. The bottom end is formed on around an outer surface with a first protruded section and a second protruded section located lower than the first protruded section, such that an engagement groove is defined between the first protruded section and the second protruded section. The second protruded section has an upward-facing contact surface and an interference pressing surface defined on an outermost peripheral surface of the second protruded section. The top end of the central tube is extended through the through hole of the base from a lower side thereof, such that the second protruded section is press-fitted into the tapered receiving recess in the axial direction of the base, and the interference pressing surface is radially outward forced against the inward inclined wall of the tapered receiving recess. In the meantime, the free end of the second section of the base is fitted in the engagement groove and clamped in place by between the first protruded section and the second protruded section.

According to the embodiment of the present invention, the upward-facing contact surface of the second protruded section is in contact with the downward-facing contact surface of the second section of the base; and an annular pressing protrusion is formed on the upward-facing contact surface of the second protruded section to correspondingly engage with the annular pressing groove on the downward-facing contact surface of the second section of the base.

According to the embodiment of the present invention, the first protruded section has a downward-facing bevel surface adapted to contact with the second section of the base.

According to the embodiment of the present invention, the free end of the second section of the base has an upward-facing chamfered edge adapted to correspondingly engage with the downward-facing bevel surface of the first protruded section.

According to the embodiment of the present invention, the base and the central tube are arranged in a fan frame.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The above objects and the structural and functional features of the present invention will now be described with a preferred embodiment thereof and by referring to the accompanying drawings.

Figure 1:
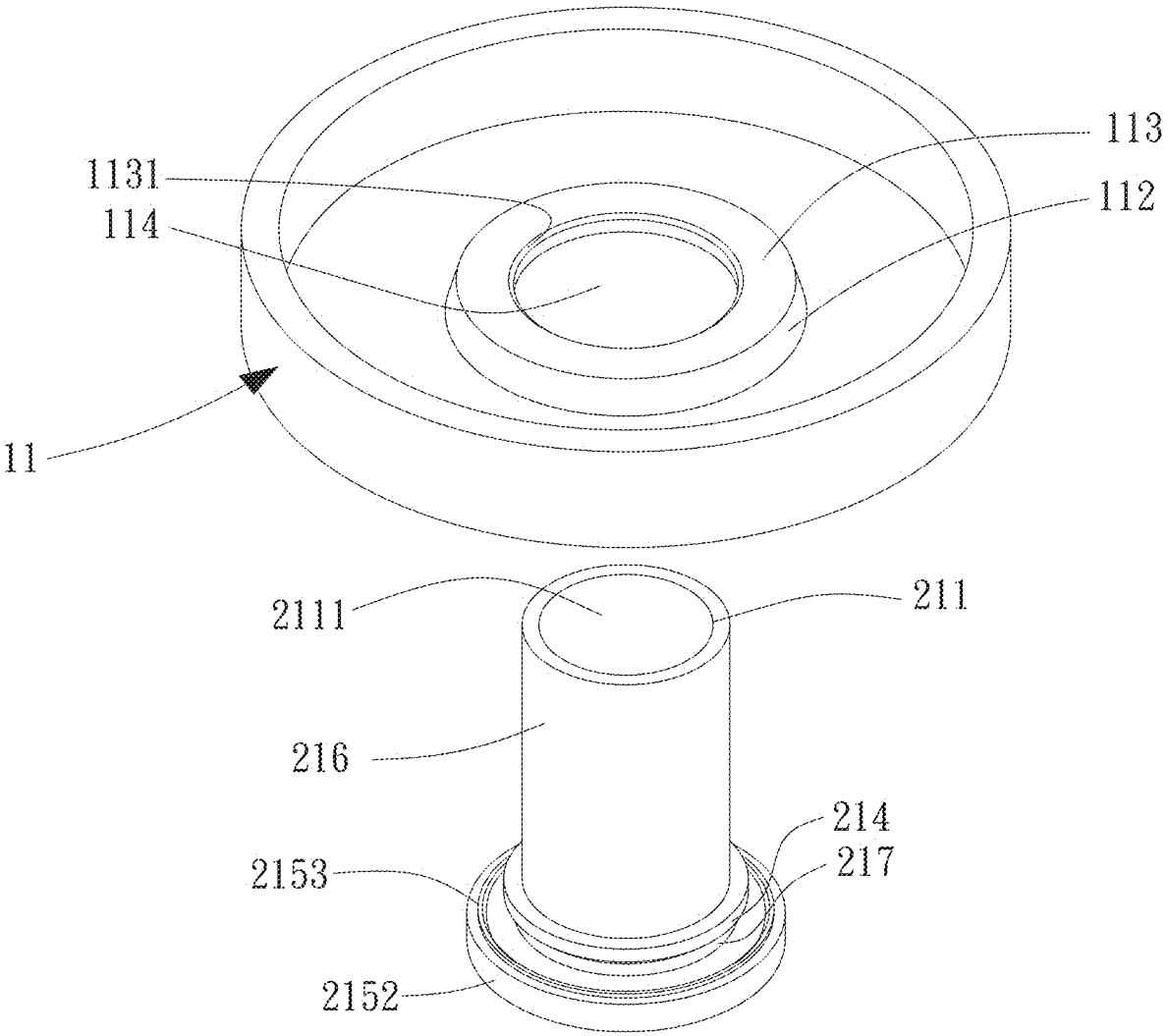
FIG. 1 is an exploded perspective view showing the fan central tube coupling structure according to a preferred embodiment of the present invention.
Figure 2:
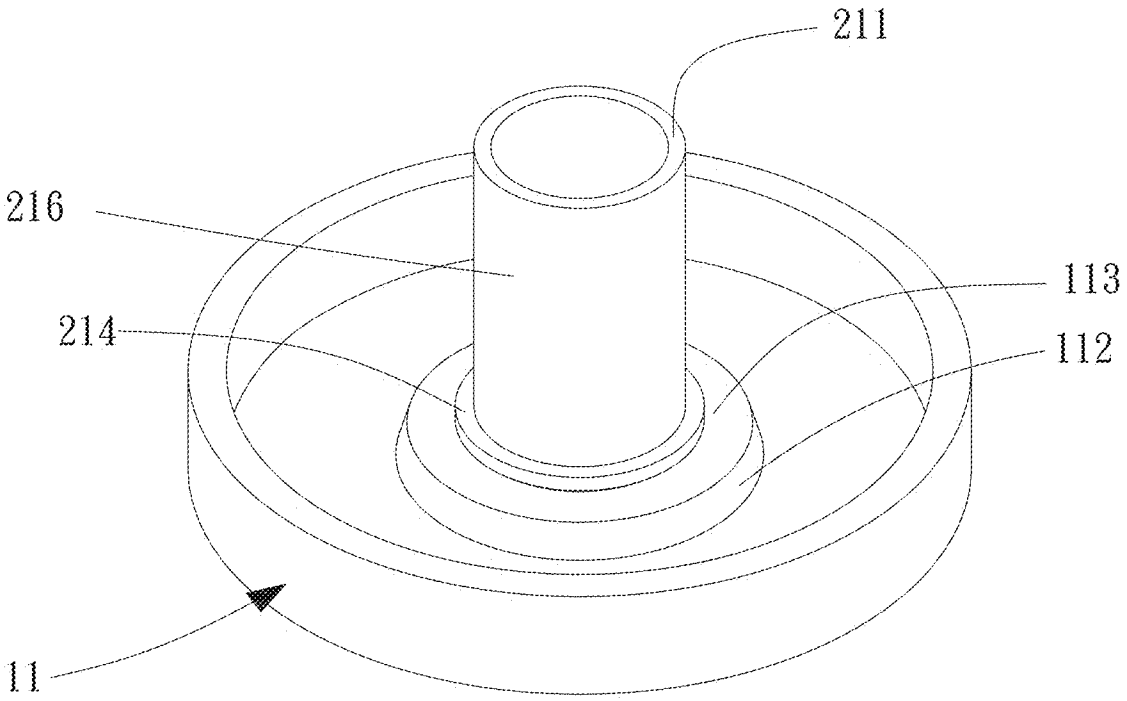
FIG. 2 is an assembled view of FIG. 1.
Figure 3:
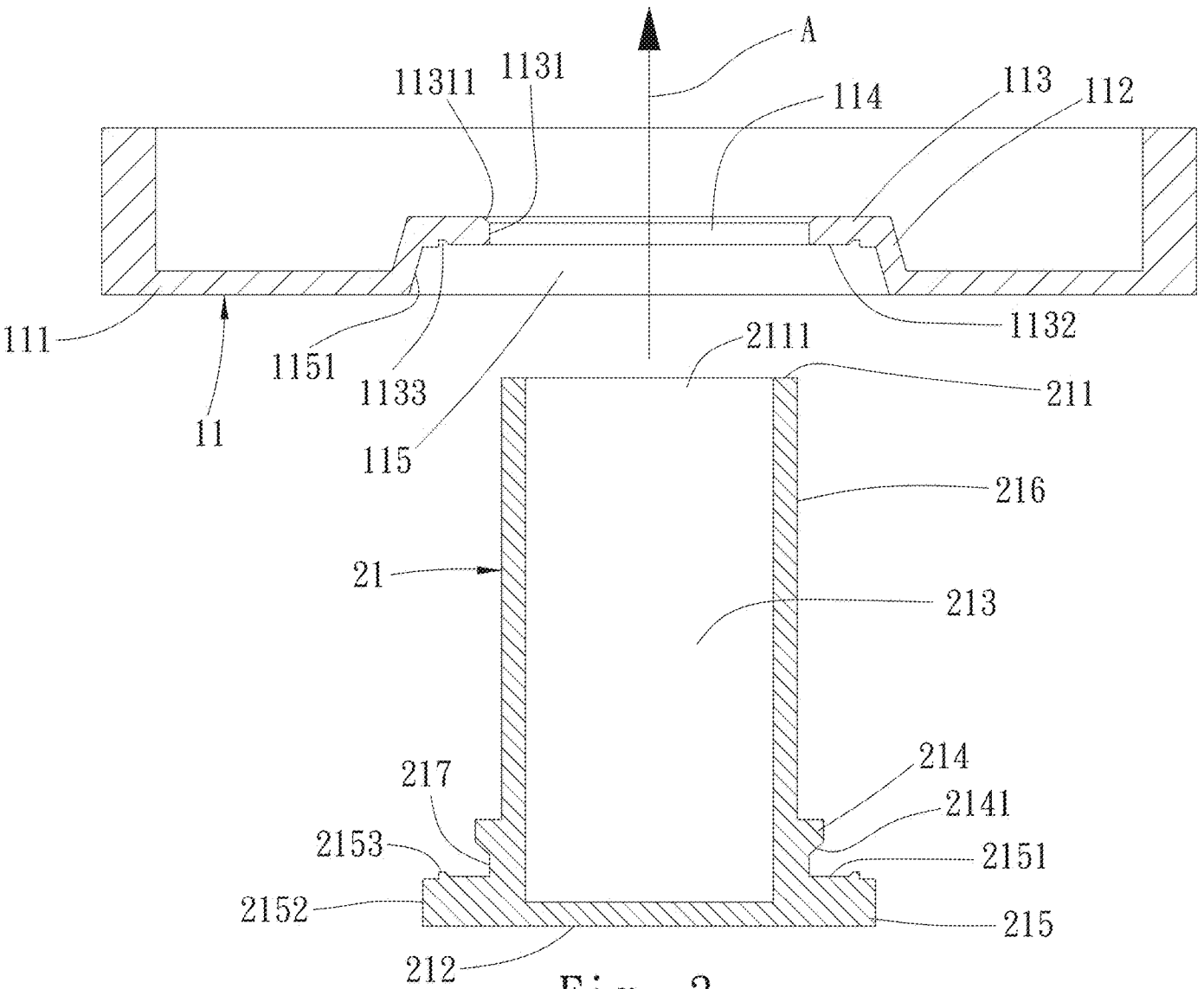
FIG. 3 is an exploded sectional view of the fan central tube coupling structure according to the preferred embodiment of the present invention shown in FIG. 1.
Figure 4:
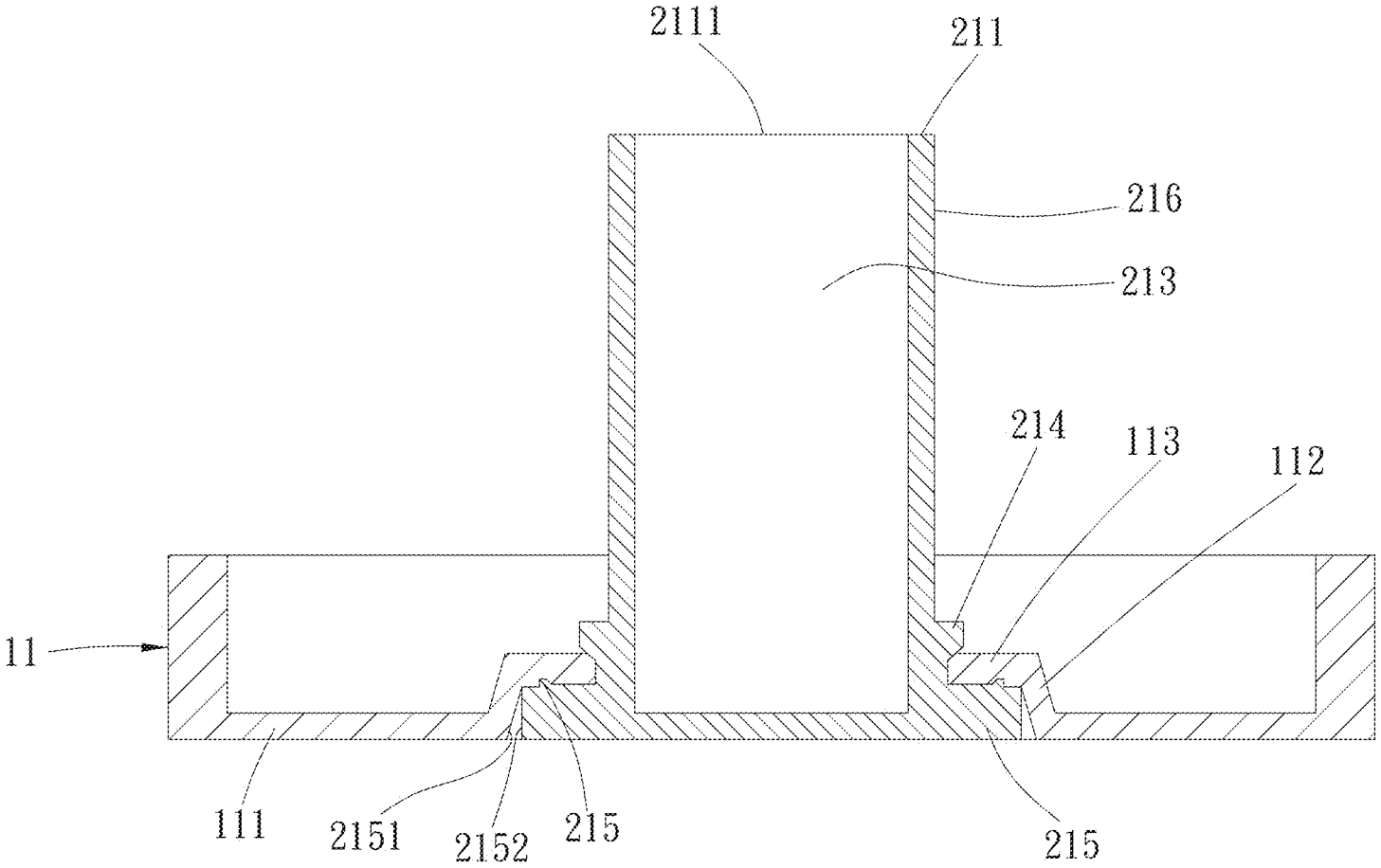
FIG. 4 is an assembled view of FIG. 3.

Please refer to FIGS. 1 and 2, which are exploded and assembled perspective views, respectively, showing the fan central tube coupling structure according to a preferred embodiment of the present invention; and to FIGS. 3 and 4, which are exploded and assembled sectional views, respectively, of the fan central tube coupling structure shown in FIGS. 1 and 2. As shown, the fan central tube coupling structure of the present invention includes a base 11 and a central tube 21. The base 11 has a bottom portion 111 with a first section 112 and a second section 113 formed near and around a center of the bottom portion 111. The first section 112 stands relative to the bottom portion 111 to upward extend and taper in an axial direction A of the base 11. The second section 113 is connected at a radially outer edge to the first section 112 and has a radially inner free end 1131 that radially inward and horizontally extends to define a through hole 114 substantially centered at the bottom portion 111 of the base 11. The first section 112 and the second section 113 further together define an upward tapered receiving recess 115 below the second section 113, and the tapered receiving recess 115 is communicable with the through hole 114. One side of the second section 113 facing the tapered receiving recess 115 is a downward-facing contact surface 1132, on which an annular pressing groove 1133 is formed. One side of the first section 112 facing the tapered receiving recess 115 forms an inward inclined wall 1151 of the tapered receiving recess 115. As can be most clearly seen in FIGS. 3 and 4, the tapered receiving recess 115 is diametrically upward reduced. In other words, an end of the tapered receiving recess 115 closer to the second section 113 (illustrated as a top side in the drawing) has an area smaller than that of another end of the tapered receiving recess 115 farther away from the second section 113 (illustrated as a bottom side in the drawing).

The central tube 21 has a top end 211 and a bottom end 212, and internally defines a receiving space 213. The top end 211 defines an opening 2111 communicable with the receiving space 213. The bottom end 212 is formed on around an outer surface 216 with a first protruded section 214 and a second protruded section 215. The second protruded section 215 is located lower than the first protruded section 214, such that an engagement groove 217 is defined between the first protruded section 214 and the second protruded section 215. Further, the second protruded section 215 has an upward-facing contact surface 2151 and an interference pressing surface 2152, with the latter being defined on an outermost peripheral surface of the second protruded section 215.

The base 11 and the central tube 21 are coupled to each other by riveting them together using a hydraulic press, or more specifically, by extending the top end 211 of the central tube 21 through the through hole 114 of the base 11 from a lower side thereof, such that the second protruded section 215 is press-fitted into the tapered receiving recess 115 in the axial direction A. At this point, the interference pressing surface 2152 of the central tube 21 is radially outward forced against the inward inclined wall 1151 of the tapered receiving recess 115 until the upward-facing contact surface 2151 of the second protruded section 215 is in contact with the downward-facing contact surface 1132 of the second section 113 of the base 11. An annular pressing protrusion 2153 is formed on the upward-facing contact surface 2151 of the second protruded section 215 to correspondingly engage with the annular pressing groove 1133 on the downward-facing contact surface 1132 of the second section 113 of the base 11. The free end 1131 of the second section 113 is finally fitted in the engagement groove 217 and clamped in place by between the first protruded section 214 and the second protruded section 215.

Particularly, the interference pressing surface 2152 of the second protruded section 215 is interference-fitted or press-fitted in the tapered receiving recess 115 to also axially press against the inward inclined wall 1151 of the tapered receiving recess 115, such that the annular pressing protrusion 2153 formed on the second protruded section 215 is fitted in the annular pressing groove 1133.

Moreover, the first protruded section 214 has a downward-facing bevel surface 2141 adapted to contact with the second section 113 of the base 11, and the free end 1131 of the second section 113 of the base 11 has an upward-facing chamfered edge 11311 adapted to correspondingly engage with the downward-facing bevel surface 2141. With these arrangements, the free end 1131 fitted in the engagement groove 217 can be released from the latter and the central tube 21 can be pulled out from the through hole 114 of the base 11 as necessary.

Figure 5:
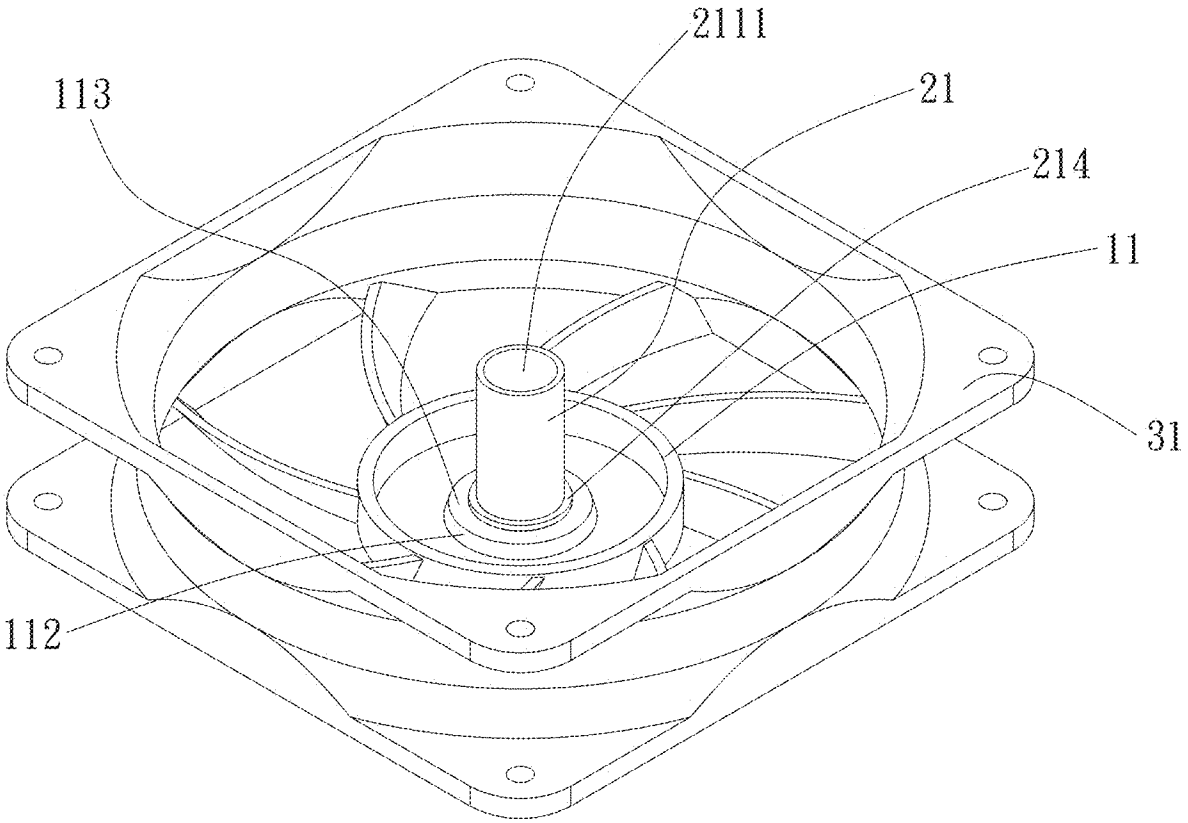
FIG. 5 is an assembled perspective view showing the arrangement of the fan central tube coupling structure of the present invention in a fan frame.
Figure 6:
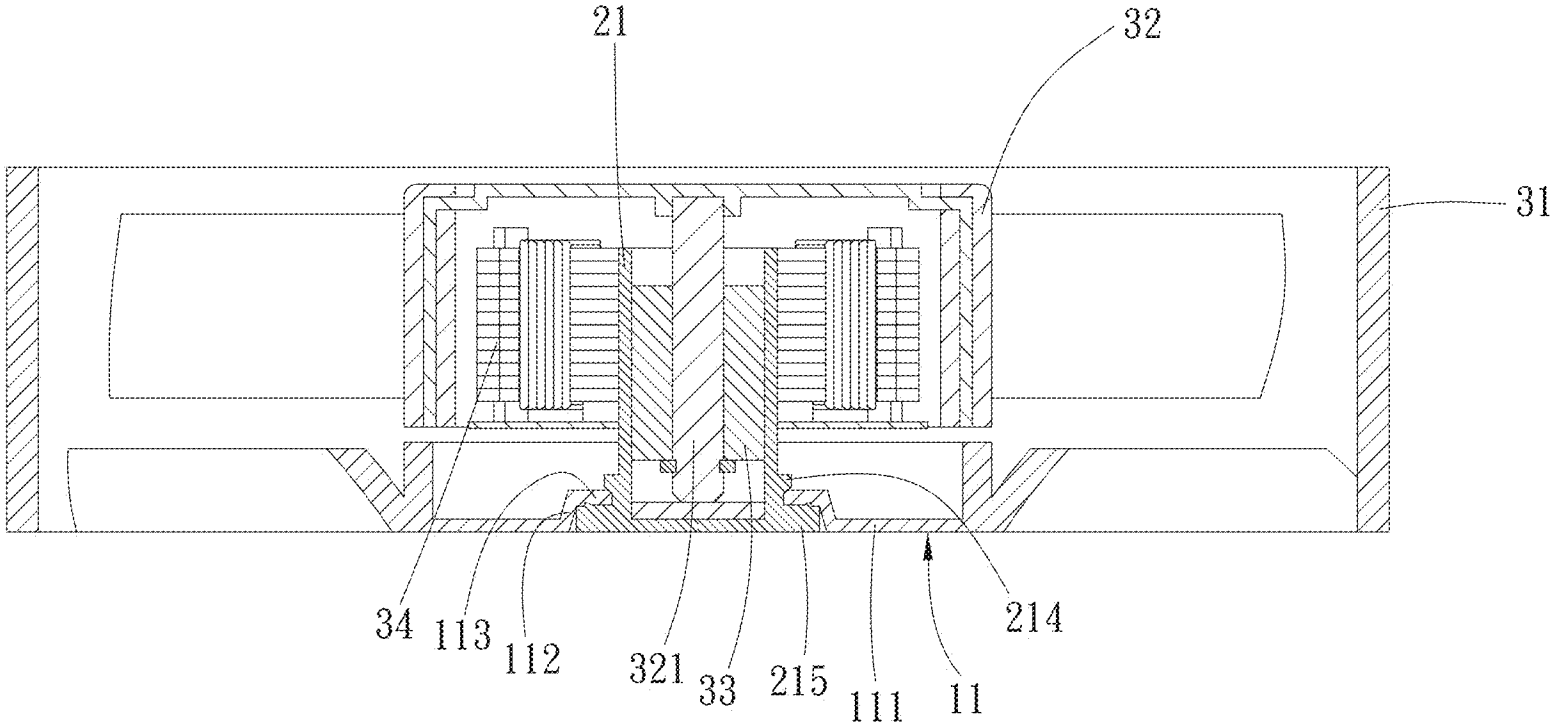
FIG. 6 is an assembled sectional view showing the arrangement of the fan central tube coupling structure of the present invention in a fan frame.

FIGS. 5 and 6 are assembled perspective and sectional views, respectively, showing an exemplary arrangement of the fan central tube coupling structure of the present invention in a fan frame 31. As shown, the base 11 is fixedly held to a central position of the fan frame 31 by a plurality of connecting ribs that are circumferentially spaced on and substantially radially outward extended from an outer peripheral wall of the base 11 to the fan frame 31, so that a fan wheel 32 can be mounted on around the central tube 21. At least one bearing 33 is fitted in the receiving space 213 of the central tube 21, a shaft 321 is inserted into the central tube 21 to extend through the bearing 33, and a stator unit 34 is fitted around the central tube 21 and capable of driving the fan wheel 32 to rotate when electricity is supplied to the stator unit 34.

In summary, the fan central tube coupling structure according to the present invention is characterized in that the free end 1131 of the second section 113 of the base 11 is fitted in the engagement groove 217 and clamped in place by the first protruded section 214 and the second protruded section 215 while the annular pressing protrusion 2153 is fitted in the annular pressing groove 1133, which generates a force to hold the central tube 21 immovable relative to the base in the axial direction. Also, the present invention is characterized in that the interference pressing surface 2152 of the second protruded section 215 is press-fitted in the tapered receiving recess 115, which generates a force to hold the central tube 21 immovable in the radial direction. Therefore, the base 11 and the central tube 21 are more tightly and accurately coupled together. Moreover, the contact between the upward-facing contact surface 2151 of the second protruded section 215 of the central tube 21 and the downward-facing contact surface 1132 of the second section 113 of the base 11 enables an increased heat transfer area and efficiency between the central tube 21 and the base 11.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A fan central tube coupling structure comprising a base and a central tube axially coupled to the base, the base having a bottom portion with a first section extending axially upward and with an exterior surface tapering inwardly, a central through-hole, a second section extending inwardly from an upper circumferential outer edge of the first section to an inner circumferential free edge, and an interior upwardly tapered receiving recess below the second section, and wherein the central tube is inserted through the through-hole of the base and has a first protruded section and a second protruded section located lower than the first protruded section, such that an engagement groove is defined between the first and the second protruded section; and the second protruded section being axially press-fitted into the tapered receiving recess and having an interference pressing surface defined on an outermost peripheral surface of the second protruded section adapted to radially press against the tapered receiving recess; and wherein the inner circumferential free edge of the second section of the base is fitted in the engagement groove and clamped in place between the first protruded section and the second protruded section.

2. A fan central tube coupling structure comprising a base having a bottom portion with a first section and a second section formed thereon; the first section standing relative to the bottom portion to upward extend and externally inwardly taper in an axial direction of the base; the second section being connected at a radially outer edge to the first section and having a radially inner free end that radially inward and horizontally extends to define a through hole on the base; the first section and the second section together defining an inward receiving recess tapering inwardly below the second section, and the inward tapered receiving recess being communicable with the through hole, wherein the first section is an annular wall of the inward receiving recess and the second section is a top wall of the inward receiving recess and one side of the first section facing the inward tapered receiving recess being an inward inclined wall and one side of the second section facing the inward tapered receiving recess being a downward-facing contact surface, on which an annular pressing groove is formed and a central tube having a top end and a bottom end and internally defining a receiving space; the top end defining an opening communicable with the receiving space; the bottom end being formed on around an outer surface with a first protruded section and a second protruded section located lower than the first protruded section, such that an engagement groove is defined between the first protruded section and the second protruded section; the second protruded section having an upward-facing contact surface and an interference pressing surface defined on an outermost peripheral surface of the second protruded section; and wherein the top end of the central tube is inserted through the through hole of the base from a lower side thereof, such that the second protruded section is press-fitted into the inward tapered receiving recess in the axial direction of the base, the interference pressing surface is radially outward forced against the inward inclined wall of the inward tapered receiving recess, and the free end of the second section of the base is fitted in the engagement groove and clamped in place by between the first protruded section and the second protruded section.

3. The fan central tube coupling structure as claimed in claim 2, wherein the upward-facing contact surface of the second protruded section is in contact with the downward-facing contact surface of the second section of the base; and wherein an annular pressing protrusion is formed on the upward-facing contact surface of the second protruded section to correspondingly engage with the annular pressing groove on the downward-facing contact surface of the second section of the base.

4. The fan central tube coupling structure as claimed in claim 2, wherein the first protruded section has a downward-facing bevel surface adapted to contact with the second section of the base.

5. The fan central tube coupling structure as claimed in claim 4, wherein the free end of the second section of the base has an upward-facing chamfered edge adapted to correspondingly engage with the downward-facing bevel surface of the first protruded section.

6. The fan central tube coupling structure as claimed in claim 2, wherein the base and the central tube are arranged in a fan frame.

* * * * *